US005484147A

United States Patent [19]

Fagan

[11] Patent Number: 5,484,147

[45] Date of Patent: Jan. 16, 1996

[54] HOCKEY PUCK CAROM WALL PRACTICE APPARATUS

[76] Inventor: Kenneth C. Fagan, 165 N. Main St., Carsonville, Mich. 48419

[21] Appl. No.: 203,362

[22] Filed: Mar. 1, 1994

[51] Int. Cl.[6] ..... A63B 69/00

[52] U.S. Cl. ..... 273/57.2; 273/411

[58] Field of Search ..... 273/411, 126 R, 273/51, 118 R, 57.2; 473/31

[56] References Cited

U.S. PATENT DOCUMENTS

| | | | |
|---|---|---|---|
| D. 138,928 | 9/1944 | Tweed | 273/118 R |
| 1,119,673 | 12/1914 | Bellany | 273/126 R |
| 2,159,966 | 5/1939 | Dunham | 273/126 R |
| 2,312,882 | 3/1943 | Cusano | 273/126 R |
| 2,317,126 | 4/1943 | Biderman | 273/126 R |
| 3,138,387 | 6/1964 | Michel et al. | 473/31 |
| 4,392,647 | 7/1983 | Golebieski | 273/411 |
| 4,575,078 | 3/1986 | Fogarty | 773/31 |
| 4,619,455 | 10/1986 | Ouraishi | 273/118 R |
| 4,957,288 | 9/1990 | Kantner | 473/3 |

FOREIGN PATENT DOCUMENTS

| | | | |
|---|---|---|---|
| 465837 | 4/1914 | France | 273/118 R |
| 617398 | 8/1935 | Germany | 273/126 R |
| 136999 | 8/1952 | Sweden | 273/126 R |
| 369341 | 3/1932 | United Kingdom | 273/126 R |
| 526673 | 9/1940 | United Kingdom | 273/126 R |
| 2068742 | 8/1981 | United Kingdom | 273/118 R |

*Primary Examiner*—Theatrice Brown
*Attorney, Agent, or Firm*—John P. Moran

[57] ABSTRACT

A hockey practice apparatus including a plurality of interconnected arcuate shaped segments forming a substantially half circle section, and at least one tangential segment connected to one end of the half circle section. Projecting a hockey puck at an angle against the tangential section causes it to follow around the half circle section and exit back into the playing area. For more versatile practice, an eccentrically mounted roller at the exit end of the half circle section serves to return the puck to the playing area in various directions at random.

7 Claims, 1 Drawing Sheet

HOCKEY PUCK CAROM WALL PRACTICE APPARATUS

FIELDS OF THE INVENTION

This invention relates generally to athletic equipment and, more particularly to hockey practice apparatus.

BACKGROUND ART

Heretofore, hockey has been practiced on standard hockey rinks, or by erecting make-shift nets on frozen ponds or other frozen areas.

DISCLOSURE OF THE INVENTION

A general object of the invention is to provide an improved apparatus for efficiently practising hockey skills by amateurs and hockey enthusiasts of all ages.

Another object of the invention is to provide hockey practice apparatus which is portable and adapted to being readily assembled and disassembled at a selected practice site.

A further object of the invention is to provide hockey practice equipment which provides a means for practising one's shots of the puck on goal and automatically returning the puck to the playing area for continual, uninterrupted play.

Still another object of the invention is to provide such an apparatus which is adapted to automatically returning the puck to the playing area in random directions.

A still further object of the invention is to provide hockey practice apparatus including a substantially half circle return wall section, with a tangential target section extending from one end of the half circle wall.

A still further object of the invention is to provide such a substantially half circle section and associated tangential section on one end thereof, with an accessory eccentrically mounted roller mounted at the other end of the half circle to provide a puck return in random directions.

Still another object of the invention is to provide hockey practice apparatus including a predetermined number of segments, say, five, interconnectable to form the substantially half circle return section and a further predetermining number of segments, say, two, connectable at one end of the half circle to form the tangential target section.

These and other objects and advantages will become more apparent when reference is made to the following drawings and the associated description.

BRIEF DESCRIPTION OF THE INVENTION

BEST MODE OF CARRYING OUT THE INVENTION

Figures 1, 2, 3, 4, 5, 6, 7, 8, 9, 10, 11, 12:
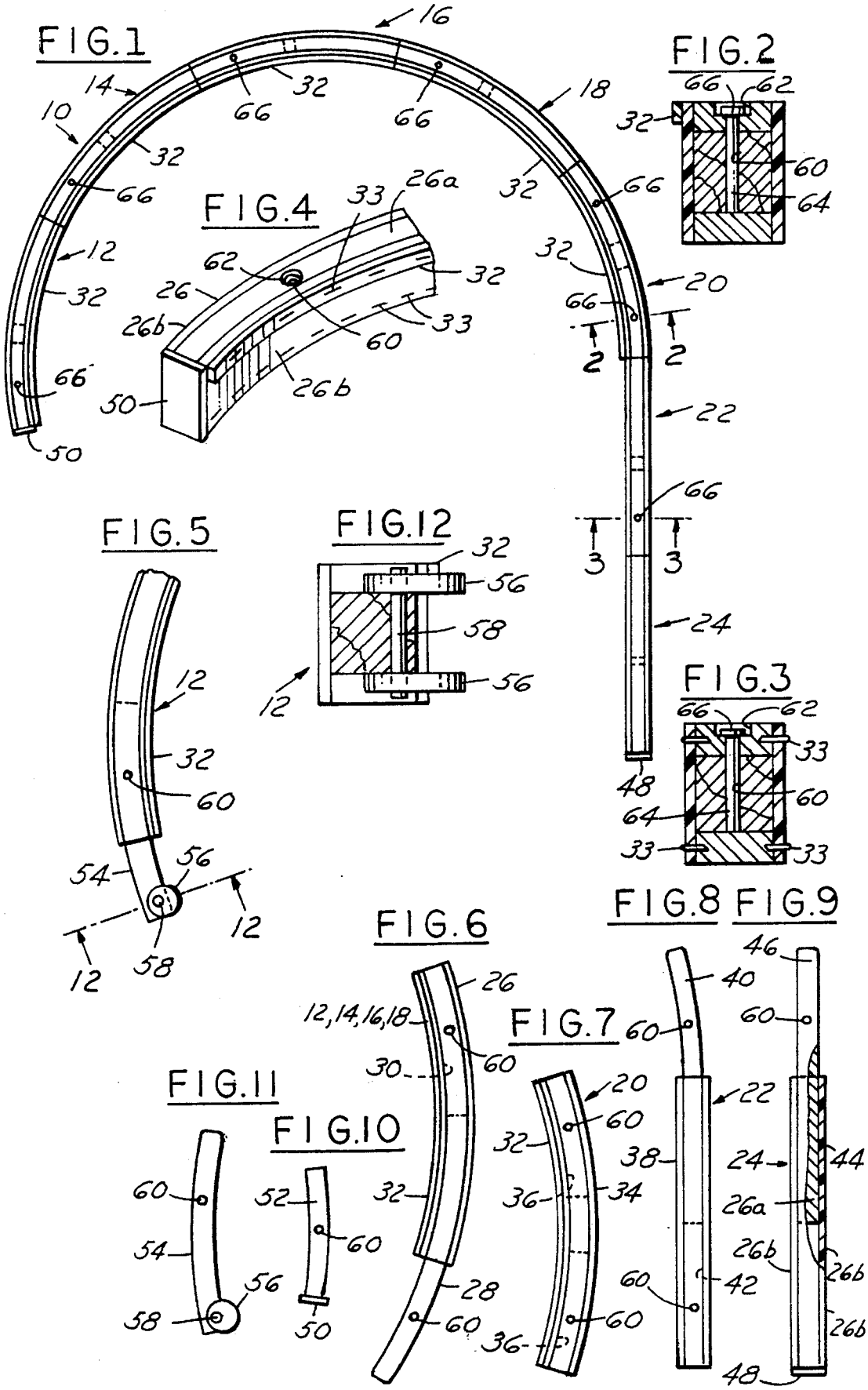
FIG. 1 is a perspective view of hockey practice apparatus embodying the invention.
FIG. 2 is a cross-sectional view taken along the plane of the line 2—2 of FIG. 1, and looking in the direction of the arrows.
FIG. 3 is a cross-sectional view taken along the plane of the line 3—3 of FIG. 1, and looking in the direction of the arrows.
FIG. 4 is a perspective view of an end segment of the FIG. 1 structure.
FIG. 5 is a plan view of a portion of the FIG. 1 structure with an accessory in place.
FIG. 6 is a plan view of a straight segment of the FIG. 1 structure.
FIG. 7 is a plan view of a further straight segment of the FIG. 1 structure.
FIG. 8 is a plan view of an arcuate segment of the FIG. 1 structure.
FIG. 9 is a plan view of each of a plurality of arcuate segments of the FIG. 1 structure.
FIG. 10 is a plan view of a removable end cap for the FIG. 1 structure.
FIG. 11 is a plan view of an accessory which may replace the removable end cap of FIG. 10.
FIG. 12 is an enlarged cross-sectional view taken along the line 12—12 of FIG. 5, and looking in the direction of the arrows.

Referring now to the drawings in greater detail, FIG. 1 illustrates a hockey practice apparatus including interconnected arcuate shaped segments 12, 14, 16, 18 and 20, and tangential segments 22 and 24.

Each of the segments 12, 14, 16 and 18 (FIG. 6) includes an arcuate shaped body portion 26 having a smaller arcuate shaped extension 28 formed on one end thereof, and an opening 30 formed in the other end thereof, adapted to slidably receive an extension 28 of an adjacent segment. As shown in FIG. 4, each arcuate segment has a rectangular cross-section (FIG. 4), and includes a lip 32 formed along the upper concave edge portion of the segment.

Each body portion 26 (FIG. 4) is formed of wood **26*a* with suitable plastic, such as polyethylene, forming the outer layers 26*b* and the inner upper lip 32, the layers and lip being retained in any suitable manner, such as by staples 33**.

As shown in FIG. 7, the segment 20 includes an arcuate shaped body portion 34 having openings 36, the same as the opening 30, formed in the oppositely disposed ends thereof.

As shown in FIG. 8, the segment 22 includes a straight body portion 38 having an arcuate shaped extension 40, the same as the extensions 28 of FIG. 6, formed on one end thereof, and an opening 42 formed in the other end thereof. The straight segments 22 (FIGS. 3 and 8) and 24 (FIGS. 3 and 9) do not have a lip mounted at the upper inner edge thereof.

As shown in FIG. 9, the segment 24 includes a straight body portion 44, the same as the body portion 38, and a smaller straight extension 46 formed on one end thereof, and a plastic end cap 48 secured on the face of the other end thereof.

As shown in FIG. 10, a plastic end cap 50 is secured to the face of an arcuate extension 52, the same as the extension 28.

As shown in FIGS. 11 and 12, an arcuate extension 54, longer than the arcuate extension 52, has upper and lower rollers 56 mounted by an off-center pivot pin 58 adjacent one end thereof, for a purpose to be described.

Once the plurality of separated segments 12, 14, 16, 18 (FIG. 6), 20 (FIG. 7), 22 (FIG. 8) and 24 (FIG. 9) and extensions 52 and 54 have been taken to a game site, the assembly of same is accomplished by slidably inserting the extension 28 of the first arcuate segment 12 into the opening 30 of the segment 14 and, in turn, slidably inserting the extension 28 of the second segment 14 into the opening 30 of the segment 16; the extension 28 of the third segment 16 into the opening 30 of the segment 18; and the extension 28 of the segment 18.

Then, the extension 28 of the segment 18 is slidably inserted into one opening 36 of the segment 20, after which the arcuate extension 40 of the straight segment 22 is slidably inserted into the other opening 36. The straight extension of the last straight segment 24 is then slidably mounted into the opening 42 of the straight segment 22. As mentioned above, the segment 24 includes the fixed end cap 48.

At this point a selected one of the extension 52 and its end cap 50, or the extension 54 and its rollers 56, is slidably inserted into the opening 30 of the first segment 12.

Each interconnected segment has a vertical hole 60 formed through the upper thickness and into the inner extension adjacent each end thereof. A countersunk recess 62 (FIGS. 2 and 3) is formed at the entrance of the hole 60. A plastic stem 64 with a head 66 is placed in the hole 60 and the recess 62. This completes the assembled unit 10 of FIG. 1.

In use, the hockey player shoots the puck toward the segments 24, 22 and 20. Upon contacting any of the latter segments, the puck then follows the contour of the remaining segments 18, 16, 14 and 12, leaving the end segment 12 in a constant direction if the extension 52 is in place, or in any one of varying directions at random if the extension 54 and eccentrically mounted rollers 56 are in place. While only the lower roller 56 is effective for directing the puck, the use of upper and lower rollers permits the interchange of the extension 54 and the tangential segments 20 and 22 for selecting right or left hand play.

Since the puck is retained against the inner surfaces of the segments by the upper lip 32, and always returns into the playing area, practice can continue at a rapid pace with minimal interruption.

It should be apparent that, by using the apparatus 10, practice is carried out in a very effective and beneficial manner, without time consuming interruptions.

It should also be apparent that either more shorter or fewer longer segments may be used in lieu of the seven segments described above.

It should be further apparent that various materials, other than those described above, may be used to form the segments.

While but one general embodiment of the invention, with two directional modifications thereof, have been shown and described, other modifications thereof are possible within the scope of the following claims.

What is claimed is:

1. A hockey practice apparatus for use on a selected playing area, the apparatus comprising a substantially half circle section and a tangential section connected to one end of the half circle, each section having a vertical inner wall for directing a hockey puck projected against the tangential section on around the half circle section and back into the playing area, and at least one eccentrically mounted roller at the other end of the half circle section for directing puck in various directions at random.

2. The hockey practice apparatus described in claim 1, wherein said half circle section includes a plurality of interconnected segments, and said tangential section includes at least one segment.

3. The hockey practice apparatus described in claim 2, wherein adjacent segments include respective openings and solid extensions slidably interconnected.

4. The hockey practice apparatus described in claim 3, and an opening formed vertically through each segment into the inner extension, and a plastic retention pin inserted in the opening.

5. The hockey practice apparatus described in claim 1, wherein each section is formed of wood with a plastic sheet forming said vertical inner wall thereof.

6. The hockey practice apparatus described in claim 1, and a lip formed by a strip secured around the upper edge portion of the vertical inner wall to prevent the hockey puck from leaving the wall vertically.

7. The hockey practice apparatus described in claim 1, and a plastic end plate mounted on said tangential section.

* * * * *